US005520781A

United States Patent [19]

Curham et al.

[11] Patent Number: 5,520,781

[45] Date of Patent: May 28, 1996

[54] METHOD OF INHIBITING WET STRENGTH RESIN DEPOSITION IN PAPERMAKING FELTS

[75] Inventors: Kevin D. Curham; Abdul Q. Khan, both of Jacksonville, Fla.

[73] Assignee: Betz PaperChem, Inc., Jacksonville, Fla.

[21] Appl. No.: 392,279

[22] Filed: Feb. 22, 1995

Related U.S. Application Data

[63] Continuation of Ser. No. 133,541, Oct. 7, 1993, abandoned.

[51] Int. Cl.[6] ..... D21F 1/32

[52] U.S. Cl. ..... 162/199; 162/DIG. 3; 162/DIG. 4

[58] Field of Search ..... 162/199, DIG. 4, 162/158, 164.3, 179, DIG. 3

[56] References Cited

U.S. PATENT DOCUMENTS

| | | | |
|---|---|---|---|
| 3,146,158 | 8/1964 | Donnelly | 162/179 |
| 3,150,035 | 9/1964 | Eddy | 162/199 |
| 3,642,572 | 2/1972 | Endres et al. | 162/164 |
| 3,893,885 | 7/1975 | Ziemann et al. | 162/164 |
| 4,722,964 | 2/1988 | Chan et al. | 524/608 |
| 4,895,622 | 1/1990 | Barnett et al. | 162/199 |
| 4,995,944 | 2/1991 | Aston et al. | 162/199 |
| 5,189,142 | 2/1993 | Devore et al. | 528/339.3 |
| 5,223,096 | 6/1993 | Phan et al. | 162/158 |

FOREIGN PATENT DOCUMENTS 0359590 3/1990 WIPO .

OTHER PUBLICATIONS

"The Mechanism of Wet–Strength Development by Alkaline–Curing Amino Polymer–Epichlorohydrin Resins"; H. Espy, T. Rave; TAPPI Journal; May, 1988 pp. 133–137.

"Wet–Strength Mechanism of Polyaminoamide–Epichlorohydrin Resins"; D. Devore, S. Fischer; TAPPI Journal; Aug., 1993; pp. 121–128.

*Primary Examiner*—Peter Chin

*Attorney, Agent, or Firm*—Alexander D. Ricci; Steven D. Boyd

[57] ABSTRACT

This invention relates to an improved press felt conditioning treatment which controls the deposition of poly(aminoamide)—epichlorohydrin type resins in a press felt. The treatment comprises applying to the felt an effective inhibiting amount of a conditioner comprising: an ethoxylated nonylphenol having greater than about 30 moles of ethoxylation; sodium n-hexadecyl diphenyloxide disulfonate; a fatty acid imidazoline or an alkylamidopropyldimethylamine which include an alkyl hydrophobe substituent having a carbon chain length of about 18.

8 Claims, No Drawings

METHOD OF INHIBITING WET STRENGTH RESIN DEPOSITION IN PAPERMAKING FELTS

This is a continuation of application Ser. No. 08/133,541 filed on Oct. 7, 1993 now abandoned.

FIELD OF THE INVENTION

The present invention relates to inhibiting contamination of felts of a papermaking system. More particularly, the present invention relates to a press felt conditioner which controls contamination by wet strength resins.

BACKGROUND OF THE INVENTION

In several types of papermaking processes, water soluble wet strength resins are added to the pulp furnish to increase the end use wet strength properties of the paper products. Items such as paper towels, napkins and tissues as well as other specialty paper grades are formed from pulp furnish which includes wet strength resins. These wet strength resins enhance the strength of the end product when wet.

Wet strength resins which allow the end product paper to retain more than 15% and up to 50% of its dry strength when wet are well known in the papermaking art. Various types of wet strength resins include ureaformaldehyde, melamine-formaldehyde, polyacrylamide, poly(aminoamide)-epichlorohydrin resins and their complex derivatives which are employed as pulp furnish components. The poly(aminoamide)-epichlorohydrin (PAE) type resins have become the most commercially important thermosetting resins and dominate the current paper wet strength resin market. PAE resins are water soluble cationic polymers which are typically added to the pulp furnish at an intermediate degree of polymerization so that the final cure of the polymer occurs in the dryer section of the paper machine. PAE resins are used extensively because they are neutral to alkaline curing, they impart permanent wet strength properties and they provide long shelf life. Also, because PAE resins are water soluble cationic polymers, they are effectively retained on anionic cellulosic fibers. By water soluble, it is meant that the resins are water soluble at the time they are added to the papermaking furnish. Subsequent events such as crosslinking can render the resins insoluble in water. Wet strength resins are generally believed to undergo crosslinking or other curing reaction after they have been deposited on, within, or among the papermaking fibers.

The manufacture of paper typically involves the processing of a carefully prepared aqueous fiber suspension (the pulp furnish) containing chemical additives to produce a highly uniform dry paper. Three steps included in the typical paper process are sheet forming where the suspension is directed over a porous synthetic mesh or "wire"; sheet pressing, where a formed sheet is passed through presses covered with belt-like porous felts to extract retained water from the sheet and to transfer the delicate sheet to the next final step of paper drying, commonly known as "yankee drying" in the case of tissue and towel grade papers.

Press felts commonly circulate continuously in a belt-like fashion between a sheet contact stage and a return stage. During the sheet contact stage, water along with other contaminants and additives is drawn from the sheet, usually with the aid of press rolls and/or a vacuum, into the pores of the felt and then subsequently removed from the felt.

The quality of the aqueous fiber suspension used to produce the sheet is dependent upon many factors including the composition of any recycled fibers added to to the process as well as the additives used in the preparation of the paper furnish. Thus, a variety of dissolved or suspended materials can be introduced into the manufacturing process, including both organic and inorganic materials such as talc, rosin, pitch, lignin, wet strength resins, cationic or anionic retention aids, water treatment chemicals, fines, anionic trash resins, calcium carbonate, clay, kaolin, silicon dioxide, titanium dioxide, alum, hydrolized AKD and ASA size, starch coating from broke, binding resins, ink particles, toners, dyes, etc. The ultimate result of these well intended additives in the aqueous fiber suspension is that they tend to deposit in the fine pores of the porous felts if they don't become an integral part of the sheet and are not removed from the felt continuously by chemical and/or mechanical means. The presence of wet strength resins in the process system compounds the problem. When PAE resin is present in the system, it tends to crosslink with itself and size the press felt fibers and render the felt surface nonabsorbent over time. In this situation, serious machine runnability and quality problems occur, ultimately leading to significant production loss. This is particularly true in current operations where the press felts are made of a polyamide fiber (nylon with various variations in fiber size, base structure, density, porosity, surface treatment, etc.) which generally carries a negative surface charge and possesses a high affinity for PAE type wet strength resins.

To control these problems related to PAE contaminated press felts, the felts have traditionally been mostly batch washed since few continuous felt conditioning chemicals are known to be effective. Batch cleaning products typically contain alkali, chelants, surfactant compositions and some solvents or in more severe cases, sodium hypochlorite solution is used alone. Even with these harsh and frequent batch wash treatments, PAE type wet strength resins along with other contaminants have been found difficult to remove. The use of sodium hypochlorite is relatively more effective for removing PAE resin but its detrimental effect on polyamide (nylon) fibers causes other problems such as loss of batt fibers from the felt (fiber shedding) and weakening of the felt's integrity, etc. leading to premature felt damage and short felt life. In addition, the use of chlorine based reagents is being limited in the paper industry due to increased environmental and regulatory restrictions. Batch cleaning operations where the machine is shut down also result in significant production losses.

Continuous felt conditioning chemical treatments based upon various nonionic or anionic surfactants, solvents, dispersants, etc. have been employed in the art. However, current continuous felt conditioning treatments have shown very limited efficacy toward controlling the PAE wet strength resin deposition in press felts.

SUMMARY OF THE INVENTION

The present inventors have discovered that several functionally similar members of the class: alkyl substituted fatty acid imidazoline, alkylamidopropyldimethylamine, ethoxylated nonylphenols having greater than about 30 moles of ethoxylation, and sodium n-hexadecyl diphenyloxide disulfonate are very effective, when employed as continuous felt conditioning agents, at inhibiting PAE wet strength resin contaminant deposit in press felts. The materials of the present invention also enhance the water absorbing and permeability properties of the press felts.

The press felt conditioning agents of the present invention are preferably applied by metering into one or more fresh water showers directed onto a press felt between the press nip and the vacuum or uhle box utilized for dewatering the felt. The conditioners are effective at inhibiting the deposition of PAE wet strength resin contaminants in the press felts. It was discovered that fatty acid imidazolines and alkylamidopropyldimethylamines having similar alkyl hydrophobe substituents are unexpectedly efficacious PAE type contaminant inhibitors. The alkyl hydrophobe substitutions can be saturated, unsaturated, monounsaturated or branched alkyl groups. Ethoxylated nonylphenol having greater than 30 moles of ethoxylation and sodium n-hexadecyl diphenyloxide disulfonate were also found to be effective PAE type contaminant inhibitors.

DESCRIPTION OF THE PREFERRED EMBODIMENTS

The present invention relates to a process for inhibiting the deposition of PAE type contaminants in the felts in the press section of a papermaking system. The process of the present invention comprises treating the felts, typically in an aqueous spray or shower, with a felt conditioner. The felt conditioner of the present invention comprises an effective inhibiting amount of an ethoxylated nonylphenol having greater than 30 moles of ethoxylation, a sodium n-hexadecyl diphenyloxide disulfonate, an alkyl substituted fatty acid imidazoline or an alkyl substituted amidopropyldimethylamine. The alkyl substituent is an alkyl hydrophobe radical which can be saturated, unsaturated, monounsaturated, or branched alkyl groups.

Fatty acid amidazolines in accordance with the present invention are exemplified by the general structure.

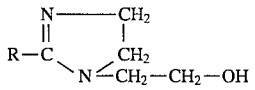

Fatty Acid Imidazoline

Alkylamidopropyldimethylamines in accordance with the present invention are exemplified by the general structure.

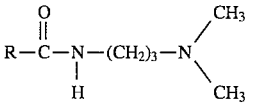

Alkylamidopropyldimethylamine

R is an alkyl hydrophobe radical with a preferred carbon chain length of $C_{18}$. R can be saturated, unsaturated, mono unsaturated or a branched alkyl group.

The fatty acid imidazoline and alkylamidopropyldimethylamine are the preferred felt conditioners of the present invention.

The press felt conditioners of the present invention are typically applied to the press felt in an aqueous shower. The conditioner is preferably metered into one or more fresh water showers directed onto a press felt between the press nip and the vacuum or uhle box utilized for dewatering the felts. The required amount or concentration of conditioner will depend on, among other things, the volume of shower water employed, the production rate, the amount of PAE resins used, etc. Generally, the total concentration of the conditioning agent of the present invention may range from about 15 to 1,200 parts per million of the aqueous medium. Preferably, the conditioning agent is added at concentrations of from about 75 to about 350 parts per million of the aqueous showering medium.

The practice of the present invention will be illustrated in the following examples. These examples are included as illustrations only and should not be construed as limiting the scope of the present invention.

EXAMPLES

The following examples demonstrate the unexpected efficacy of the felt conditioning treatment of the present invention. The data was obtained utilizing a continuous felt conditioning test apparatus and a simulated synthetic contaminant test system. The synthetic contaminant test system contained PAE wet strength resin, inorganic fillers, wood pitch and a hemicellulose substitute. The continuous felt conditioning testing incorporates a clean (unused) tissue grade press felt of known initial weight and air permeability placed on a heavy mesh support screen through which the treated and untreated contaminant solutions are pressed. After continuous conditioning testing, the sample is dried and acclimated at ambient temperature prior to retesting for percent weight gain and air permeability loss. Lower percent weight gain (less deposition) and lower numbers for permeability loss are indicative of a better performance. The simulated synthetic contaminant used in the testing is set out in Table 1.

TABLE 1

| Ingredient | Concentration in Water (ppm) |
|---|---|
| Dried PAE Resin (Kymene Plus) | 400 |
| Clay | 150 |
| Talc | 75 |
| $TiO_2$ | 25 |
| Fatty Ester Pitch | 100 |
| Carboxymethyl Cellulose (CMC) | 75 |

Kymene Plus used in the simulated contaminant composition is a commercial PAE type wet strength resin available from Hercules, Inc., Wilmington, Del.

Table 2 summarizes the test results for a number of commercially available surfactants, dispersants, polymers, reagents, and solvents studied in the testing. These commercially available materials are employed in the art for continuous or intermittent press felt conditioning of paper machine press felts. All tests were conducted at 150 ppm treatment concentration, pH 7.0 and at room temperature. Table 2 summarizes the results of the testing.

TABLE 2

| Conditioning Agent | % Weight Gain of Test Felt | % Porosity Loss of Test Felt |
|---|---|---|
| Untreated Control | 17.7 | 73.1 |
| Oleyl Imidazoline | 2.1 | 21.5 |
| Oleamidopropyldimethylamine | 2.7 | 34.5 |
| Surfactants | | |
| Ethoxylated Nonylphenol (n = 9.5)* | 10.4 | 47.9 |
| Ethoxylated Nonylphenol (n = 12)* | 11.8 | 54.8 |
| Ethoxylated Nonylphenol (n = 30)* | 6.8 | 49.2 |
| Ethoxylated Nonylphenol (n = 100)* | 8.0 | 46.9 |

TABLE 2-continued

| Conditioning Agent | % Weight Gain of Test Felt | % Porosity Loss of Test Felt |
|---|---|---|
| Ethoxylated Dinonylphenol | 12.7 | 56.3 |
| Linear Alcohol Ethoxylate Complex Phosphate Ester | 11.4 | 69.9 |
| Nonylphenol Ethoxylate Complex Phosphate Ester | 21.6 | 75.5 |
| Phenol Ethoxylate Complex Phosphate Ester | 17.5 | 78.4 |
| Primary Alcohol Ethoxylate | 18.6 | 74.7 |
| Primary Alcohol Ethoxylate | 17.0 | 87.0 |
| Secondary Alcohol Ethoxylate | 16.0 | 71.2 |
| Branched Unidecyloxoalcohol Ethoxylate | 20.6 | 75.5 |
| Branched Tridecyl Alcohol Ethoxylate | 16.8 | 73.4 |
| Alkyl Polyglucoside | 21.6 | 65.0 |
| Alkyl Betaine | 12.9 | 63.3 |
| Alkyl Sultaine | 19.1 | 79.3 |
| Sodium Diisosulfosuccinate | 23.5 | 73.6 |
| Ethoxylated Alcohol Ether Sulfate | 18.7 | 80.7 |
| Tris Alkylamido Triquatinary | 19.3 | 83.6 |
| Alkylamidopropyl Morpholine | 15.2 | 74.1 |
| Sodium n-hexadecyl Diphenyloxide Disulfonate | 6.8 | 54.6 |
| Sodium n-dodecyl Diphenyloxide Disulfonate | 12.3 | 65.8 |
| Sodium n-decyl Diphenyloxide Disulfonate | 23.9 | 73.0 |
| Sodium N-methyl-N-oleoyl Taurate | 20.8 | 69.5 |
| Sodium 2-Ethylehexyl Sulfate | 17.9 | 81.1 |
| Alkyl Pyrrolidone | 17.3 | 80.4 |
| (Propylene/Ethylene oxide) Block Copolymer | 8.9 | 47.4 |
| Dispersants | | |
| Polymethyl Napthalene Sulfonate (low MW) | 23.1 | 62.2 |
| Polymethyl Napthalene Sulfonate (high MW) | 13.2 | 73.7 |
| Sodium Lignosulfate | 15.4 | 60.7 |
| Polymers | | |
| Polyquatinary Ammonium Chloride | 14.8 | 53.8 |
| Polyvinyl Alcohol | 14.0 | 82.9 |
| Polyvinyl Pyrrolidone | 15.7 | 77.9 |
| Polyacrylic Acid | 16.5 | 76.3 |
| Poly(Methyl Vinyl Ether/Maleic Acid) | 22.4 | 85.3 |
| Solvents | | |
| Aliphatic Solvent | 21.8 | 80.9 |
| Branched Alkyl Diamine | 17.9 | 75.7 |
| Reagents | | |
| Aluminum Sulfate | 23.5 | 75.5 |
| Triethanol Amine | 17.6 | 70.2 |

*n = moles of ethylene oxide per mole of nonylphenol

The results summarized in Table 2 clearly show that the oleyl amidazoline and oleamidopropyldimethylamine are unexpectedly efficacious at controlling the percent weight gain and loss of porosity. Additional testing under the same conditions at pHs of 6.5 and 8.0 showed similar efficacy.

Table 3 summarizes the test results under the same conditions described above but for a 200 part per mill ion treatment concentration. The chain length of the R alkyl hydrophobe radical in imidazolines was varied.

TABLE 3

| | % Wt. Gain | % Porosity Loss |
|---|---|---|
| Untreated Control | 17.5 | 73.3 |
| Fatty Acid Imidazolines: | | |
| Oleyl ($C_{18}$ monounsaturated) | 2.6 | 25.5 |
| Tallow ($C_{18}$ branched) | 2.9 | 25.7 |
| Caproyl ($C_{16}$ saturated) | 14.6 | 74.3 |
| Cocco ($C_{12}$–$C_{14}$ saturated) | 16.4 | 66.6 |

The data in Table 3 shows that varying the chain length of the alkyl hydrophobe radical will significantly affect the inhibition efficacy of the treatment solution and that a chain length of a $C_{18}$ is preferred.

In addition to Kymene Plus based PAE wet strength resins, several other "Kymene" series PAE wet strength resins were tested to demonstrate the effectiveness of the present invention. Table 4 summarizes the results.

TABLE 4

| | Control | | C18 Alkylimidazoline | | C18 Alkylamidopropyl Dimethylamine | |
|---|---|---|---|---|---|---|
| Kymene Type | % Wt. Gain | % Porosity Loss | % Wt. Gain | % Porosity Loss | % Wt. Gain | % Porosity Loss |
| Kymene Plus* | 17.7* | 73.0* | 2.1* | 21.5* | 2.7* | 34.5* |
| Kymene 557** | 22.1 | 65.6 | 5.3 | 36.6 | 3.4 | 38.5 |
| Kymene 736 | 14.1 | 59.0 | 2.1 | 20.3 | 3.0 | 15.8 |
| Kymene 218 | 18.0 | 69.6 | 3.9 | 37.8 | 6.5 | 50.3 |

*Data at 150 ppm concentration of each conditioning agent. Remaining data was generated using 200 ppm concentration level of each conditioning agent.
**No carboxymethyl cellulose was needed in the contaminant system.

The data of Table 4 shows that the treatment of the present invention is effective in controlling the deposition of a number of PAE type wet strength resins in a press felt.

While this invention has been described with respect to particular embodiments thereof, it is apparent that numerous other forms and modifications of the invention will be obvious to those skilled in the art. The appended claims and this invention should be construed to cover all such obvious forms and modifications which are within the true spirit and scope of the present invention.

What is claimed is:

1. A method of inhibiting the deposition of poly(amidoamine)-epichlorohydrin type resins in press felts of a papermaking system which comprises applying to said press felts an effective inhibiting amount of a press felt conditioner selected from the group consisting of:

ethoxylated nonylphenol having more than about 30 moles of ethoxylation;

sodium n-hexadecyl diphenyloxide disulfonate;

fatty acid imidazolines of the general formula:

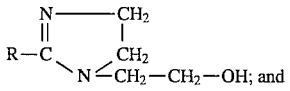

alkylamidopropyldimethylamines of the general formula:

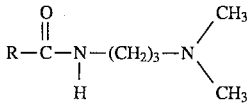

wherein R is a saturated, unsaturated, monounsaturated or branched alkyl hydrophobe radical having a carbon chain length of about 18.

2. The method of claim 1 wherein the pH of the system is from about 6.5 to about 8.0.

3. The method of claim 1 wherein said press felt is conditioned by showering with an aqueous medium including said press felt conditioner.

4. The method of claim 3 wherein said press felt conditioner is added in an amount of from about 15 to about 1,200 parts per million parts said aqueous medium.

5. A method of inhibiting the deposition of poly(amidoamine)-epichlorohydrin type resins in press felts of a papermaking system which comprises applying to said press felts an effective inhibiting amount of a press felt conditioner selected from the group consisting of:

fatty acid imidazolines of the general formula

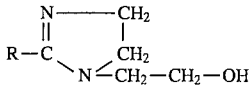

and alkylamidopropyldimethylamines of the general formula

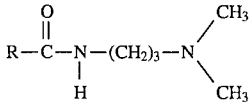

wherein R is an saturated, unsaturated, monounsaturated or branched alkyl hydrophobe radical having a carbon chain length of about 18.

6. The method of claim 5 wherein the pH of the system is from about 6.5 to about 8.0

7. The method of claim 5 wherein said press felt is conditioned by showering with an aqueous medium including said felt conditioner.

8. The method of claim 7 wherein said press felt conditioner is added in an amount of from about 15 to about 1,200 parts per million parts said aqueous medium.

* * * * *